United States Patent [19]

Beuret et al.

[11] Patent Number: 4,861,000

[45] Date of Patent: Aug. 29, 1989

[54] INSTALLATION HAVING SEVERAL ELEMENTS FOR HEAT TREATMENTS

[75] Inventors: Pierre Beuret, Route de Bure 21, 2900; Pascal Beuret, both of Porrentruy, Switzerland

[73] Assignee: Pierre Beuret, Switzerland

[21] Appl. No.: 200,417

[22] Filed: May 31, 1988

[30] Foreign Application Priority Data

Jun. 3, 1987 [CH] Switzerland ..... 2099/87

[51] Int. Cl.[4] ..... C21D 9/00

[52] U.S. Cl. ..... 266/143; 266/253; 266/263

[58] Field of Search ..... 286/142, 143, 263, 253, 286/259

[56] References Cited

U.S. PATENT DOCUMENTS

| | | | |
|---|---|---|---|
| 1,481,338 | 4/1922 | Baldwin | 266/249 |
| 1,838,015 | 12/1931 | Von Forster et al. | 266/253 |
| 1,876,960 | 9/1932 | Kenworthy | 266/253 |
| 3,381,947 | 5/1968 | Beggs | 266/259 |
| 4,415,145 | 11/1983 | Herdieckerhoff | 266/253 |

FOREIGN PATENT DOCUMENTS

| | | |
|---|---|---|
| 0167102 | 11/1950 | Austria . |
| 0023546 | 2/1981 | European Pat. Off. . |
| 1942801 | 5/1970 | Fed. Rep. of Germany . |
| 3525635 | 1/1987 | Fed. Rep. of Germany . |
| 1521505 | 3/1968 | France . |
| 0095877 | 11/1971 | France . |
| 0899793 | 6/1962 | United Kingdom . |

*Primary Examiner*—S. Kastler

*Attorney, Agent, or Firm*—Oliff & Berridge

[57] ABSTRACT

An upper line comprises three furnaces 1, 2, 3 and a washing machine 4, in straight side-by-side arrangement. A lower line comprises moveable treatment elements 7, 8, 9 movable on conveyor track 5, and fixed vat 17, Car 6 permits feeding all the elements of the upper line, as well as materials handling equipment 11, from entry station 20. Elements 7, 8, 9 and 17 can be fed either directly from the furnaces 1, 2, 3 via the materials handling equipment 11.

9 Claims, 6 Drawing Sheets

INSTALLATION HAVING SEVERAL ELEMENTS FOR HEAT TREATMENTS

BACKGROUND OF THE INVENTION

Various branches of industry more and more frequently use mass-produced parts, all in one piece, formed of alloys or other special materials having undergone heat treatments. Now, the latter may be very varied and, moreover they must satisfy very specific conditions. Hence there exists a need for installations permitting heat treatments to be effected, and comprising several elements, such as furnaces or hardening vats, arranged as a battery, and easily accessible.

Arrangements of elements permitting heat treatments to be carried out in precise and careful conditions, especially avoiding contact of the parts with the air as much as possible, are already known.

Thus, in Austrian Pat. No. 167,109, an installation is seen in which a removable-cover furnace can be displaced on a transport track above pits capable of containing various hardening vats and a charging box. U.S. Pat. No. 1,876,960 describes an annealing installation in which there is provided, below the furnace, a turntable capable of containing the charges. U.S. Pat. No. 3,381,947 likewise describes an installation with furnaces and hardening vats, as well as means for introducing the charges into the installation.

In all these known installations, there is found an arrangement comprising only a small number of elements, and which is of excessive bulkiness. Moreover, none of these installations perfectly protects the parts against the risk of oxidation.

Certificate of addition No. 95877 to French Pat. No. 1,555,588 discloses an installation in which a first set of elements is disposed in a row of furnaces opening horizontally on a transfer chute provided with a track on which elements of a second set, comprising one or more charging cars capable of being provided with hardening vats, can move. Such an installation is very bulky and involves continuous maintenance of the transfer chute under a protective atmosphere.

Installations which permit charges to be transferred from an open bottom removable-cover furnace directly into a hardening vat which has previously brought immediately beneath the furnace are described in German patent DE-1942801 and in the publication EP-A-0023546. However, these installations cannot be arranged so as to combine efficiently the use of several furnaces and several hardening vats or other auxiliary elements.

SUMMARY OF THE INVENTION

The object of the present invention is therefore to provide an efficient arrangement for the essential elements of a treatment installation, i.e., for one or more furnaces, as well as one or more treatment elements and one or more materials handling elements, in such a way that the installation permits varied treatments to be carried out in an efficient manner, the installation comprising a minimum number of elements, disposed in a simple way, with minimum bulkiness, and permitting possible extension by means of additional elements.

The subject of the invention is an installation for carrying out heat treatments on charges of metal parts comprising a first set of elements which are disposed in an upper position and which comprise at least one open-bottom furnace, a second set of elements which are disposed in a lower position and which comprise at least one hardening vat and at least one car, and stationary displacement means for bringing a charge into the furnace or the hardening vat under the furnace, characterized in that the displacement means consist of a horizontal track which constitutes the lowest portion of the installation, and in that all the elements of the second set are movable on this track and provided with autonomous lifts.

BRIEF DESCRIPTION OF THE DRAWINGS

An embodiment of the subject of the invention will be described below, by way of example, referring to the appended drawing, in which.

DETAILED DESCRIPTION OF THE PREFERRED EMBODIMENTS

Figure 1:
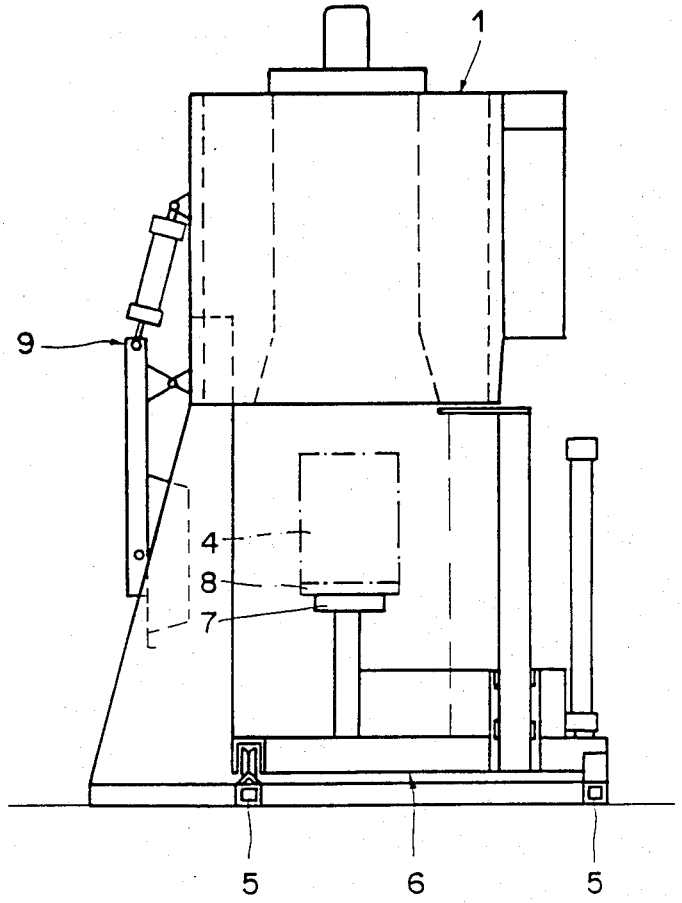
FIG. 1 is a longitudinal elevation of the installation.
Figure 2:
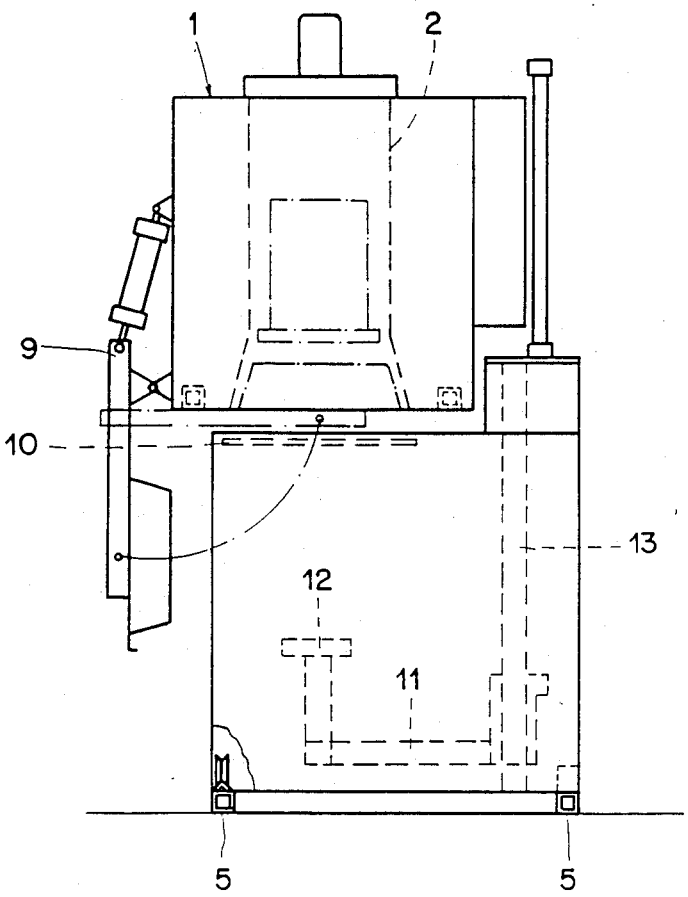
FIG. 2 is a top plan view.

The installation represented in the drawing is a multipurpose installation, comprising several fixed furnaces, several movable vats, a materials handling car, and the possibility of adding accessory elements, either fixed or movable, each treatment element co-operating with any furnace in a minimum amount of space and in such a way as to permit the achievement of all the possible combinations. As is seen in FIGS. 1 and 2, the set is arranged in two parallel and superposed horizontal lines. The upper line comprises a group of fixed furnaces 1, 2 and 3, as well as an initial station 4 which may, for example, be a multi-cycle washing station. The elements 1, 2, 3, 4 constitute a first set of elements of the installation described. In a typical embodiment, the furnace 1 will be a furnace whereby a charge can be caused to rise to 600° C., possibly to 1100° C. or even, the maximum value, to 1230° C. The furnace 2 will, for example, be a 600° C. furnace with a cooler incorporated for the purpose of allowing isothermal hardening operations. As furnace 3, there may be provided, for example, a 600° C. tempering furnace, with internal heating. Instead of or in addition to this last furnace, there might likewise be a fixed element constituting a cooling station permitting the temperature of a charge to be reduced gradually after an annealing or tempering operation. The detailed design of the elements 1 to 4 need not be described in detail. The various functions for which they may be conceived will be seen below. Generally speaking, it will be a question of elements which are provided with the accessories necessary for maintaining a charge of metal objects under a gas atmosphere and enclosing them tightly with the necessary thermal insulations. Furthermore, it will be noted that the furnace 1 might, in another embodiment, be mounted on a car and move in the direction f the upper line.

The upper line further comprises in the prolongation of the furnaces 1, 2, 3 an upper conveyor track 10, composed of two parallel rails, on which a handling equipment 11 moves. The latter is composed of a frame 12 mounted on roller 13, of a jack column 14 which constitutes the cylinder of a lift, and of a lift bar 15 which functions as a piston within the column 14 and permits a fork-shaped grabbing part 16 to be displaced in height.

Figure 3:
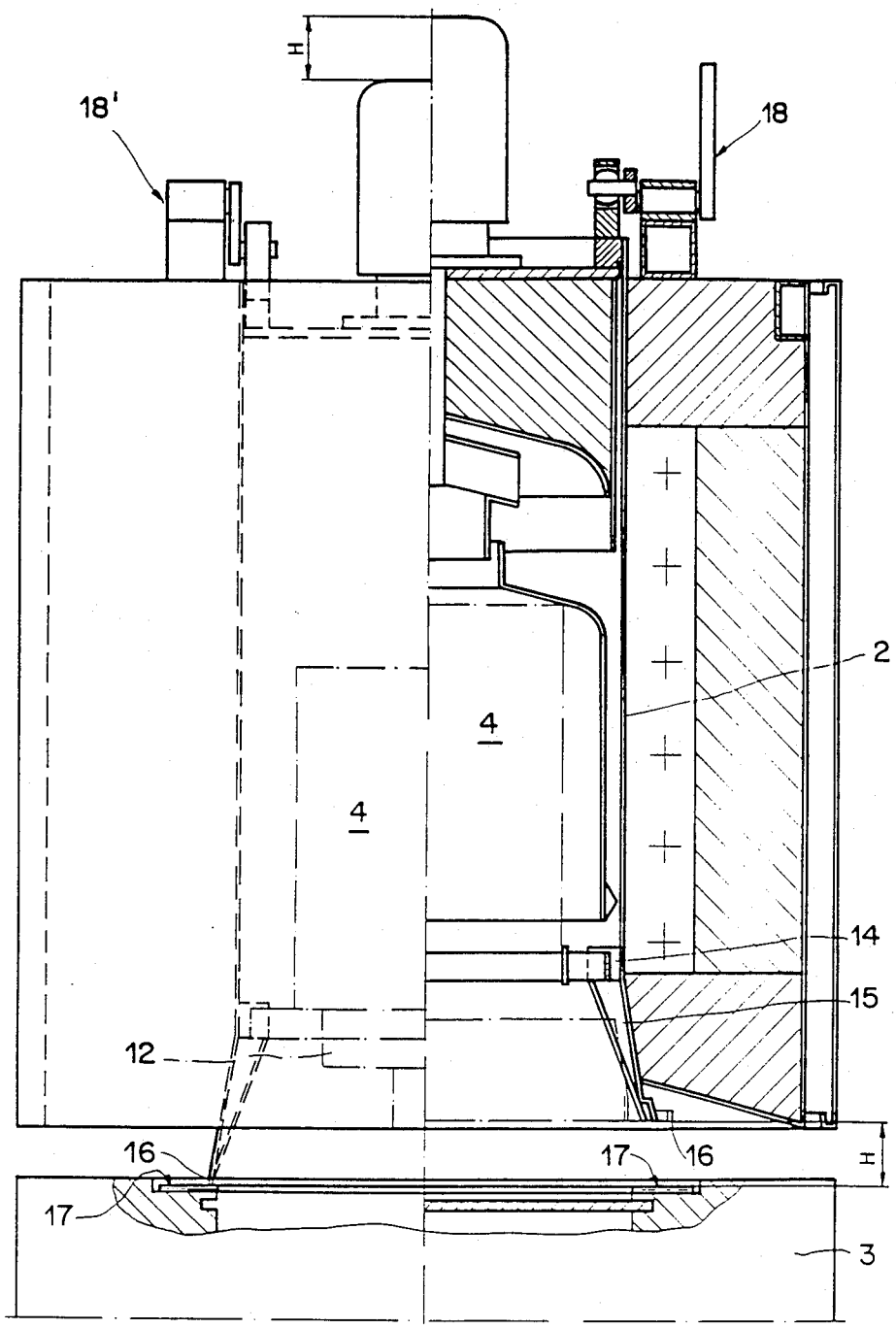
FIG. 3 is a top plan view on an enlarged scale of the entry and discharge station with the materials handling car and a series of vats.
Figure 4A:
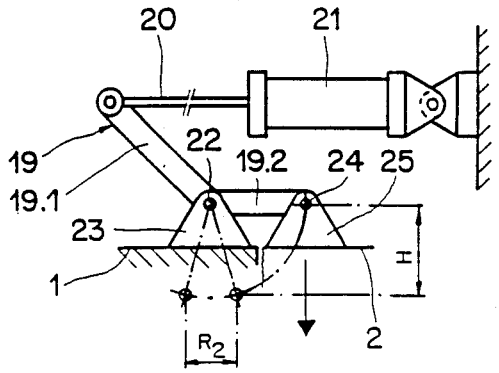
FIG. 4 is a front elevation on the same scale as in FIG. 3, showing a materials handling car and a furnace.
Figure 4B:
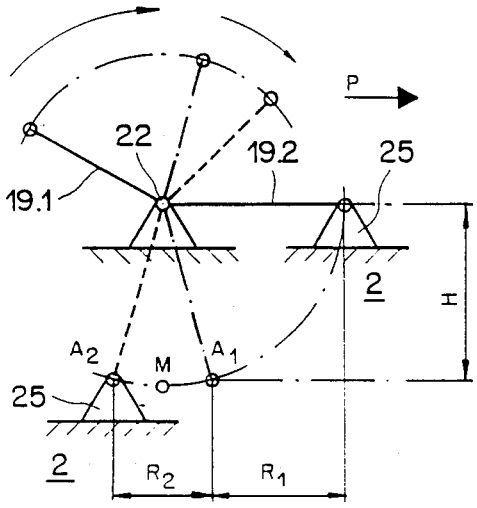

The lower line comprises at its base a conveyor track 5 formed of two horizontal rails and on which there move elements which form a second set of elements of the installation described. Thus, in FIG. 1 a materials handling car 6, and three treatment elements 7, 8 and 9 are seen. In FIG. 3 a fourth treatment element 91 is seen. These treatment elements are equipped with wheels, as will be seen below, and move together or separately on the conveyor track 5. As treatment elements one may have, on the lower line, for example, a movable vat for materials handling under atmosphere, i.e., a closed and insulated enclosure provided with a circulation of gas permitting the displacement of a charge. Another treatment element might consist of a movable furnace under atmosphere and attaining, for example, a temperature of 1100° C. A third treatment element might be a water vat, a fourth an oil vat, the oil of which would be heated to a certain temperature, e.g., 100° C. Another treatment element might be an oil vat, the oil of which might be heated to 200° C., or an isothermal salt vat.

The conveyor track 10 extends above one or more additional treatment elements such as the element 17, which is fixed. The element 17 is a gas vat, i.e., a shut enclosure in which there are provided means for circulation of a gas with if the case arises, heating means or cooling means. This gas vat may be configured in such a way that the inside atmosphere is under pressure. In the installation described, the element 17 represents a third set.

Figure 5:
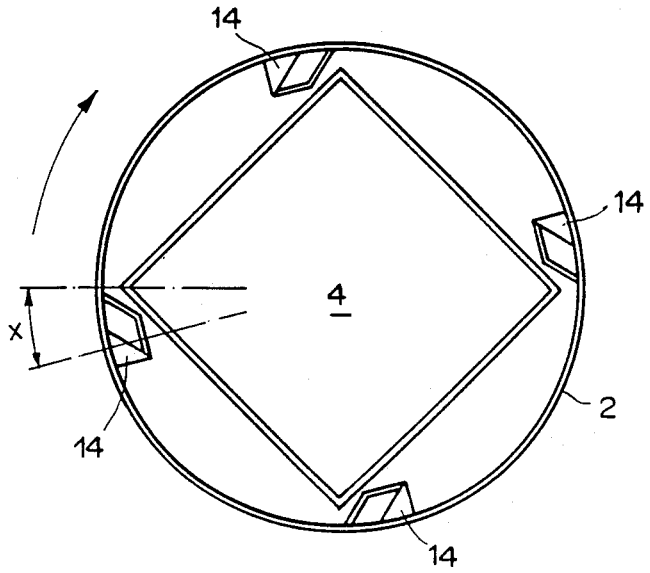
FIG. 5 is a partial longitudinal section, showing a furnace, a hardening vat, and a car.
Figure 6:
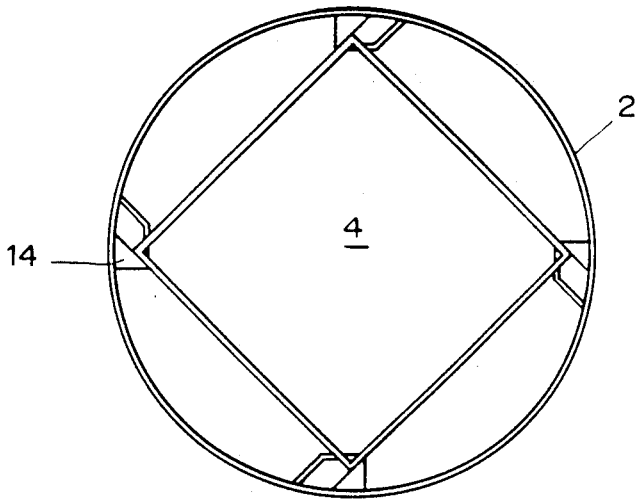
FIG. 6 is a sectional view along the line 6-6 of FIG. 5, and FIGS. 7 to 10 are elevations and plan views of two fixed treatment elements.

Before explaining the possibilities of use of these sets of elements, the latter will be further described in somewhat more detail. The charges, such as 18, reach the installation via an entry and discharge station designated generally as 19 (FIGS. 1 to 3). This station comprises a turntable 20, mounted rotatingly on a base 21. The plan shape of the turntable 20 is polygonal and, in the course of its rotations, the turntable may be stopped in different orientations, which permits loading it or unloading it, e.g., from a roller track 22 or from a supply means disposed in another direction. The turntable 20 is provided at its periphery with pairs of arms 23 constituting forks, on which support frames 24 intended to support the charges 18 are placed. When a charge is in the orientation of the axis of the lower line of the treatment installation, it may be taken up via its frame 24 onto the lift platform 25 (FIGS. 1 and 3) of the car 6. The latter is made up of an H-shaped lower frame 26 resting, via rollers 27, on the rails 5 of the lower conveyor track. It bears a hydraulic jack 28 which extends vertically, and the piston of which moves a bracket 29 integral with a support rod of the platform 25. This bracket is guided by a fixed vertical column 30 provided at the top with a stop plate 31. Motor means (not shown) may be mounted either directly on the frame 26 of the car or on the conveyor track. This therefore permits taking a charge on the entry turntable 20 and moving it under the upper line of the furnaces 1, 2, 3 and 4, the other treatment elements mounted on the conveyor track 5 in turn being displaced longitudinally over a distance sufficient to allow the car to arrive at the desired final position. Thus, FIG. 5 shows the relative positions of a treatment element, such as the element 9, for example, and of a furnace such as the furnace 2, these elements being likewise visible in FIG. 6. The furnace 2 comprises, in a conventional manner an insulating enclosure 32, heating elements 33, an upper base provided with a fan 34 driven by a motor 35, a bell 36 and, at its lower opening, a plug 37 which is mounted on a support plate 38, in turn hinged to the rear wall of the furnace 2, and maneuverable by means of a jack 39 (FIG. 6). It will be noted that the bell 36 will be equipped with projecting inside elements (36.1) and mounted on a movable support so as to be displaceable in height and rotatable according to an arrangement which is described in U.S. application No. 2145/87 of the same applicant, all the contents of which form part of the present application. A height space H (e.g., 100 mm) may be maintained between the furnace and the vat.

The elements 7, 8, 9, and 91 (FIG. 3) of the second set may be of various types. The element 9, for example, is visible in FIGS. 3 and 5. It is a vat provided with insulating and fluid-tight walls 40. Its top wall 49 comprises a square opening in which a cover 48 is placed. The inside space of this vat is divided by partitions 41 into different zones by means of which the circulation of the liquid contained in the vat can be guided. This circulation is controlled by pumps 50 (FIG. 3). A lift 42 (FIG. 6), provided with a platform 43 of the same type as the platform 25, is guided by a sleeve 44 on a fixed column 45 lodged within the enclosure. This lift is controlled by a jack 46 which is mounted vertically at the rear portion of the vat 9 so as to be able to pass behind the group of furnaces and of upper elements 1 to 4. The space requirements in plan of these elements are represented in FIG. 3. The vat 9 is mounted via rollers 47 on the rails 5, so that it can be displaced longitudinally on the conveyor track. It may likewise go under the upper conveyor track 10.

The treatment elements 7, 8 and 91 are of the same kind as that which has just been described. However, they are executed in a slightly different way since they are provided for different purposes. Element 9 is provided typically for a water or oil hardening vat. In the case of an oil vat, the enclosure may further be provided with heating elements, so as to keep this oil at the required temperature, e.g., 100° C. or 200° C. If the case arises, a nitrogen atmosphere may be maintained above the level of the liquid so as to avoid the oxidation of the parts and the oxidation of the oil. The element 91 is likewise provided with pumps 50. Here, the guide column 44, instead of being immersed in the enclosure, is separate from this enclosure and provided outside. The maneuvering jack 46 is disposed here at the same height as the vat. In this case, element 91 may be a salt hardening vat permitting isothermal hardening.

The element 8 is, as is seen in FIG. 3, of the same design as the element 9, but with the difference that here the pumps 50 are absent. Although this is not depicted in the drawing, the closure cover will be equipped with an insulation. Moreover, the walls of the enclosure are likewise provided with a thicker insulation than that of the vats 9 and 91. The treatment element 8 thus constitutes a movable furnace under verified atmosphere, and it is designed, for example, so as to be able to heat and maintain a charge at a temperature, for example, of 1100° C.

As for the element 7, the arrangement of which is practically identical to that of the element 8, although its dimension in the direction of the conveyor track 5 is less, this reduction of the dimensions stems from the fact that the insulation of the walls of the enclosure is reduced. This element can operate as a movable materials handling vat under verified atmosphere. It permits, for example, to convey a charge between one of the furnaces of the upper line and, e.g., a fixed treatment element such as those which are to be described below.

Figure 7:
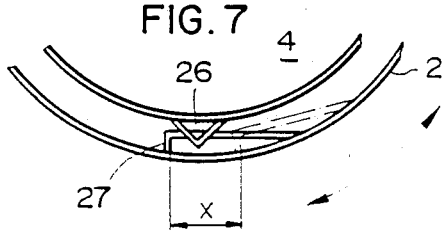
Figure 8:
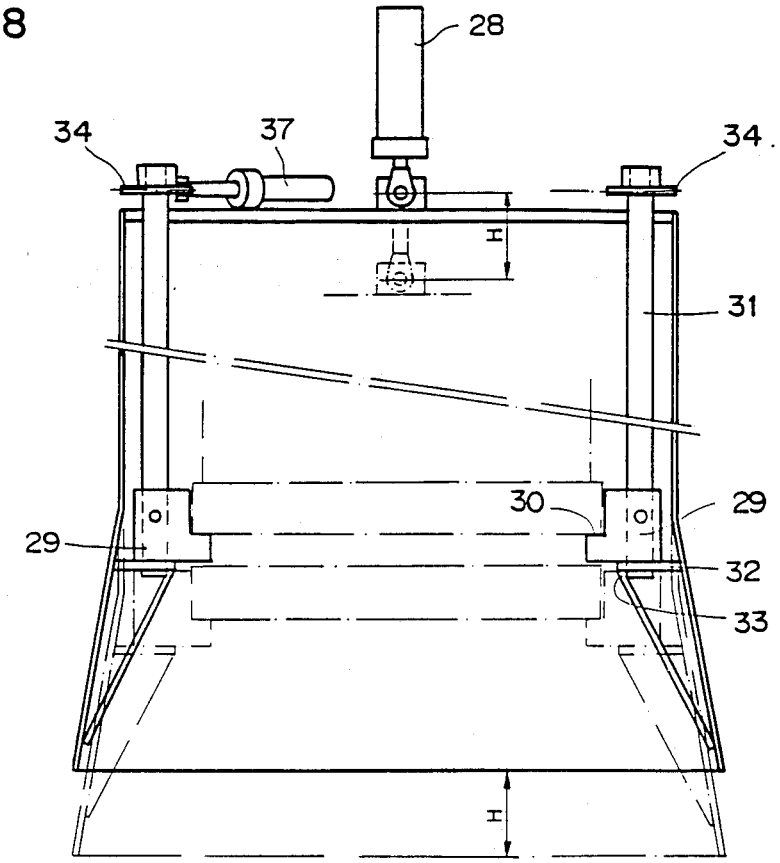
Figure 9:
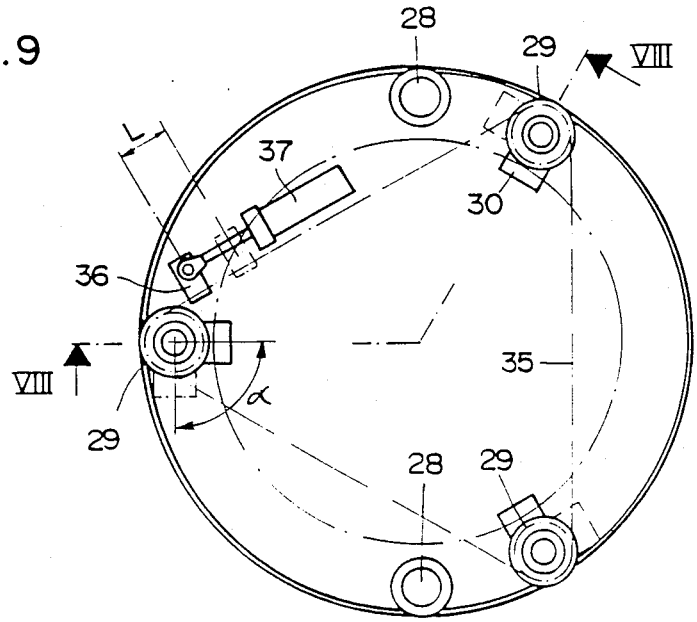

FIGS. 7 to 10 depict two types of fixed or movable treatment elements situated in the lower line, beyond the conveyor track 5 and capable of being unloaded by means of the handling equipment 11. Seen in FIGS. 7 and 9 is the upper conveyor track 10 which starts from the end of the line, i.e., from the furnace 1, and may be extended, if the case arises, up to an unloading station or otherwise as a function of the number of fixed treatment elements provided for on the lower line. The element 17 is a high-pressure gas vat. It is closed at the top by a cover 51. It comprises inside partitions 52 intended to guide the circulation of the gas within the outside walls 53 of the vat. This circulation of the gas is impelled by a fan 54 actuated by a motor 55. The arrows 56 show the path of the circulation of the gas. A movable guidance system 69 permits the reversal of the flow of gas to avoid deformation on the parts. Mounted within the enclosure 53 is a lift 57 which is of the same type as the lift 42 and is controlled by a jack 58. The bracket of the lift 57 is guided by a column 59 (FIG. 8).

FIGS. 9 and 19 depict another gas-vat design which may be lodged either beside the vat 17 or in place of this element. The vat 60 represents a design of low-pressure vats likewise permitting ensurance of the gradual cooling of the gas and, consequently, a verified variation of the temperature of the charge maintained within the element.

Figure 10:
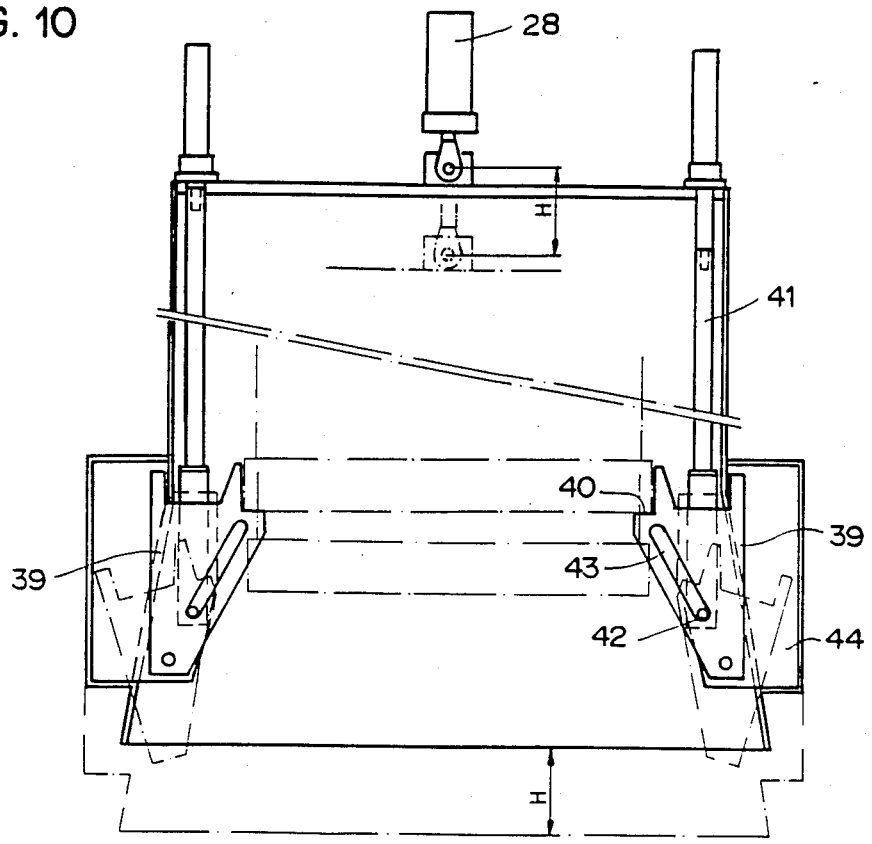
Figure 11:
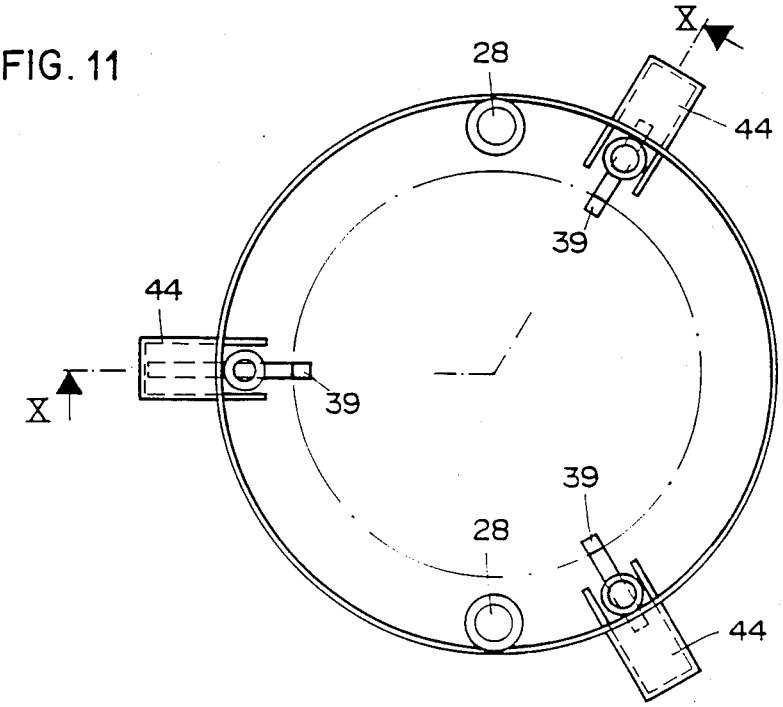
Figure 1:
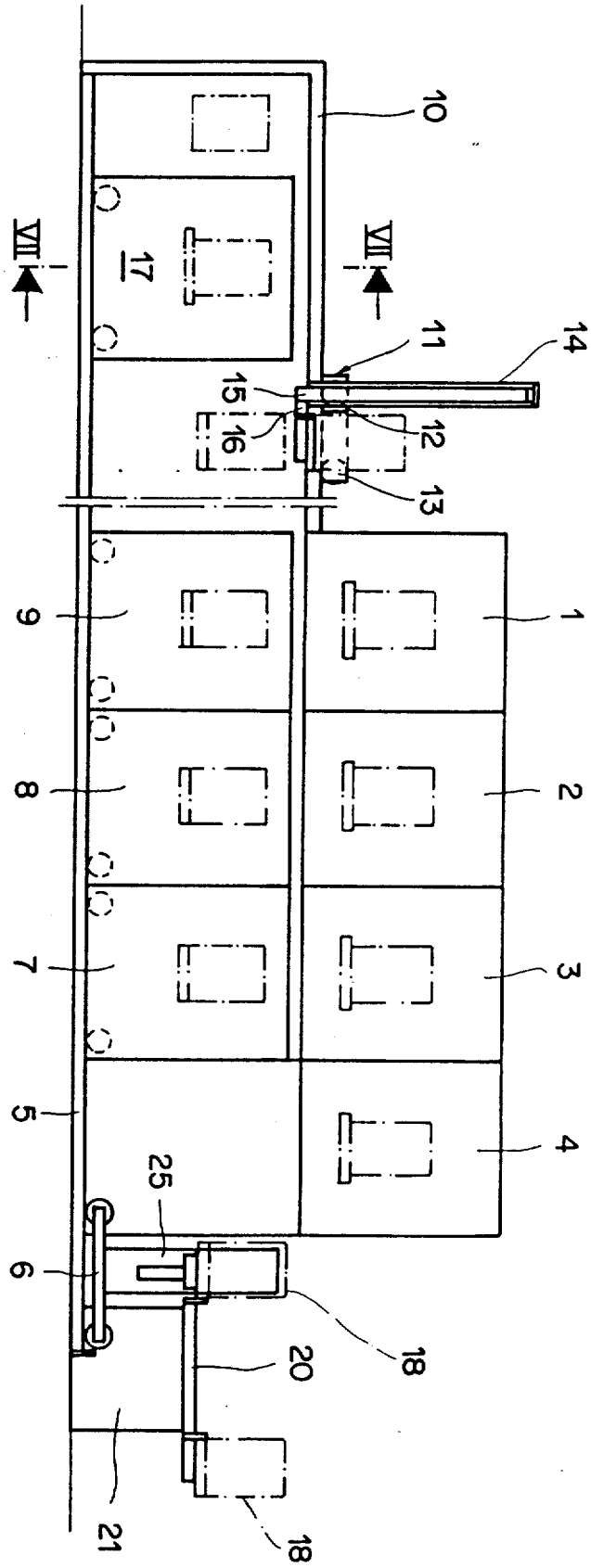
Figure 2:
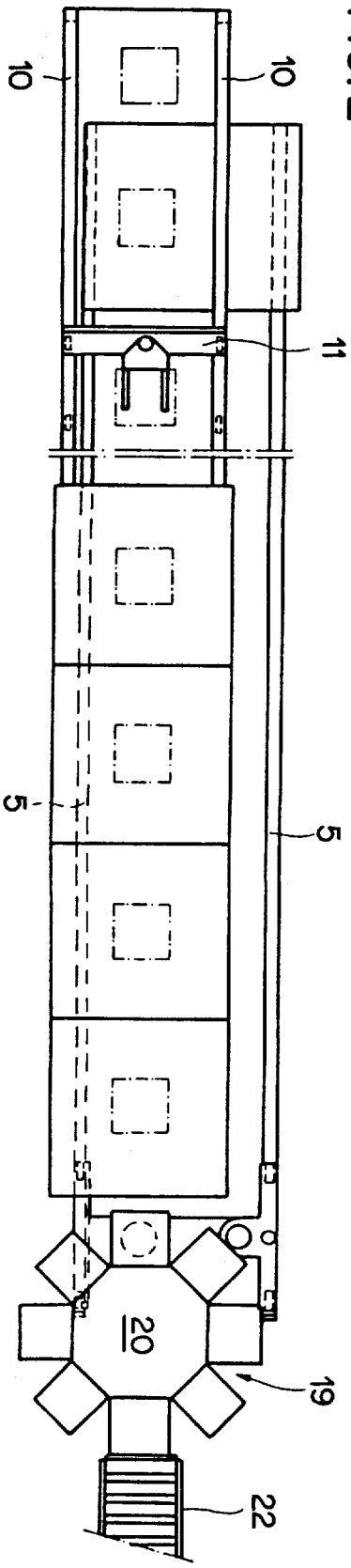
Figure 3:
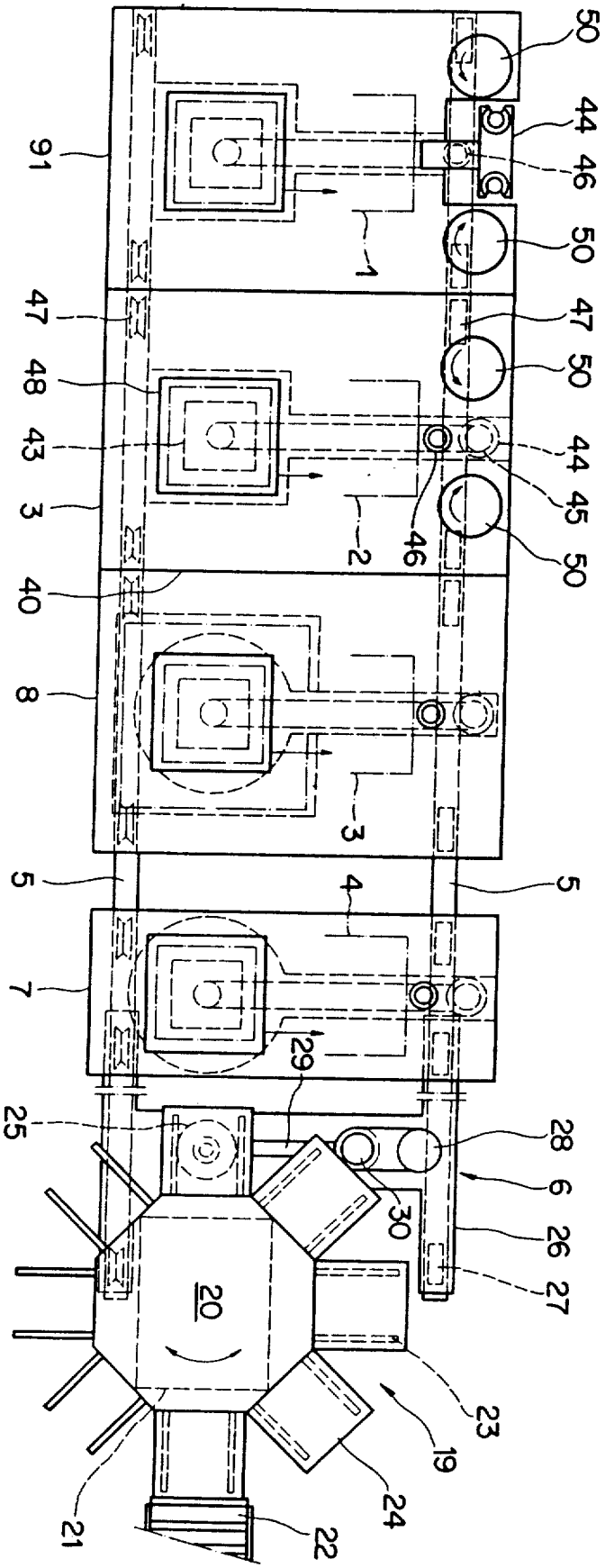
Figure 4:
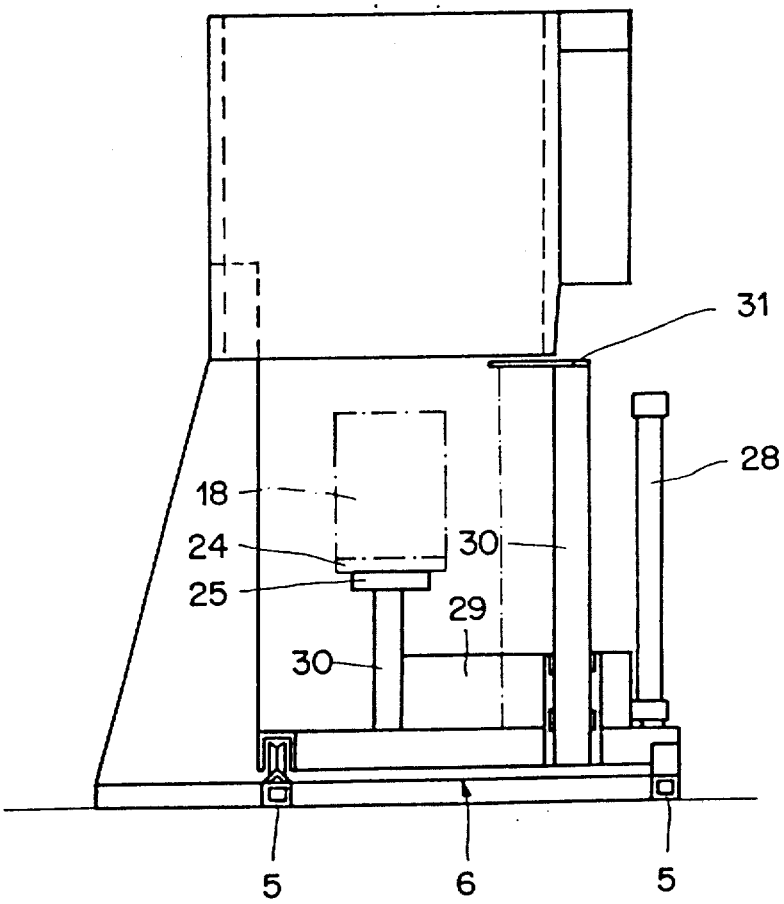
Figure 5:
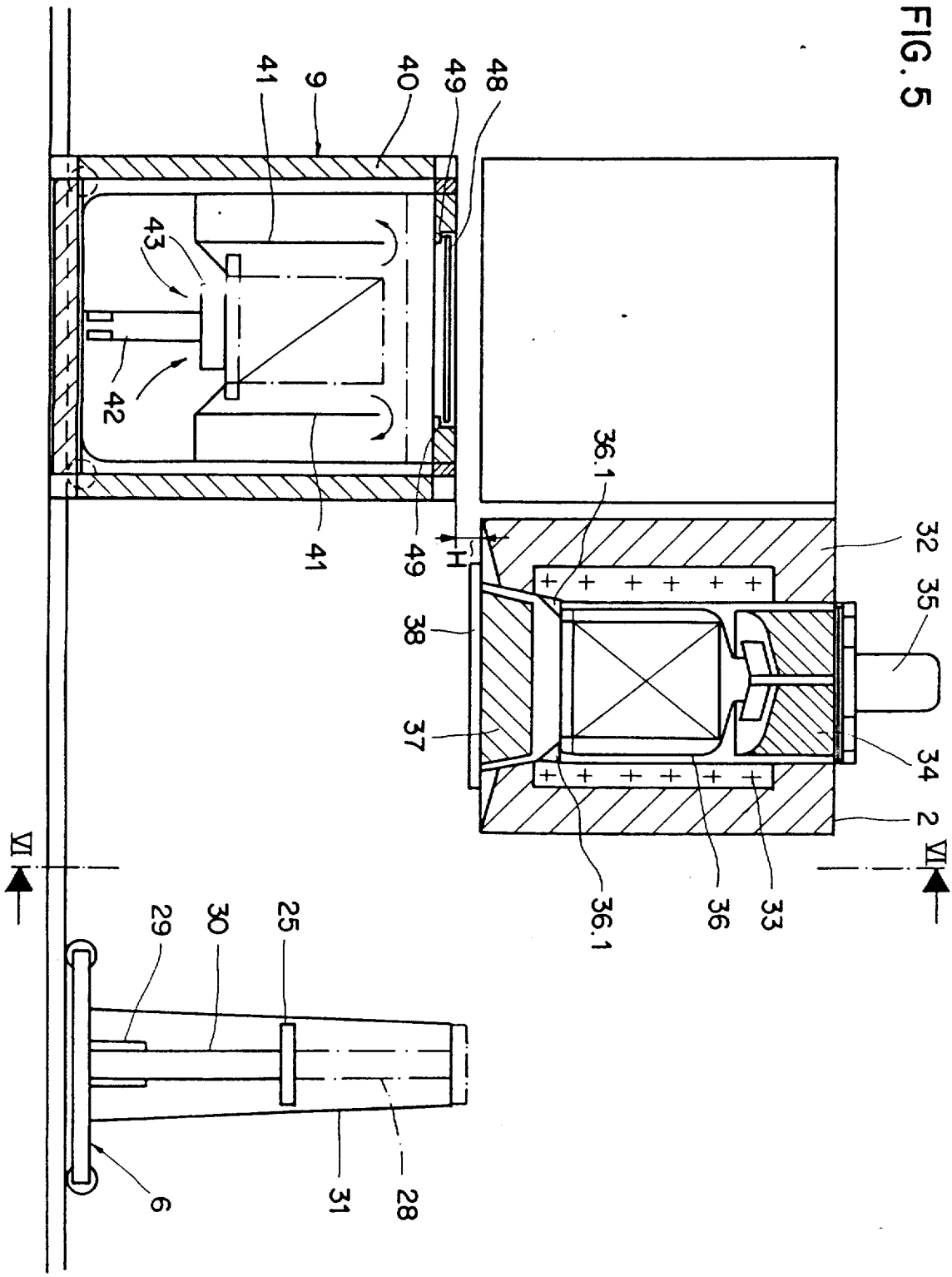
Figure 6:
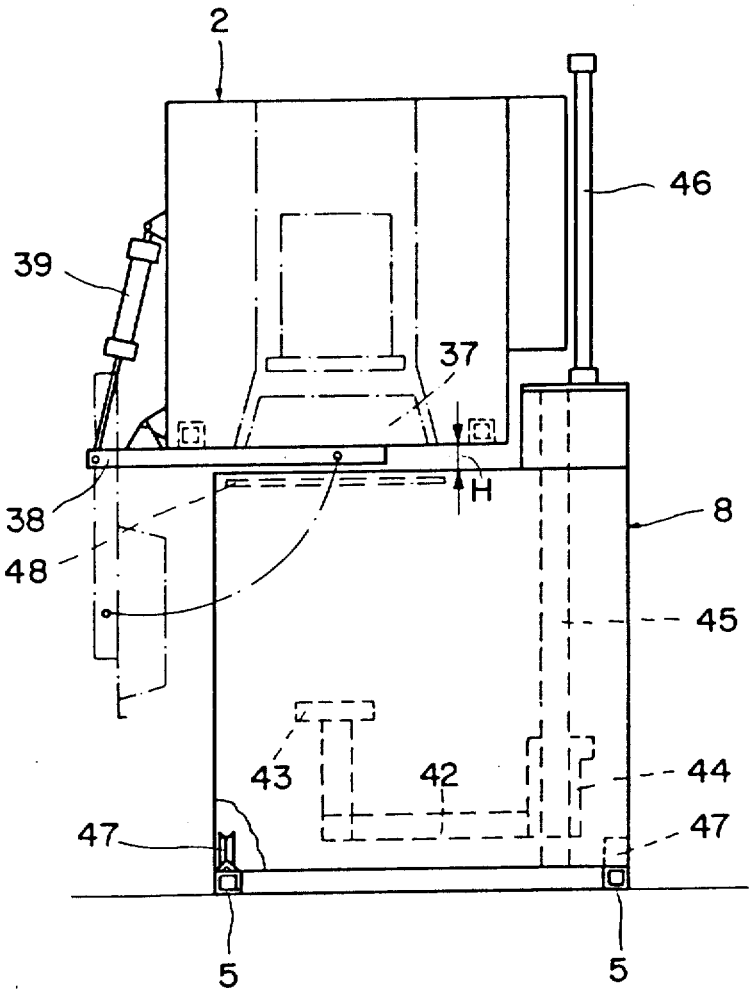
Figure 7:
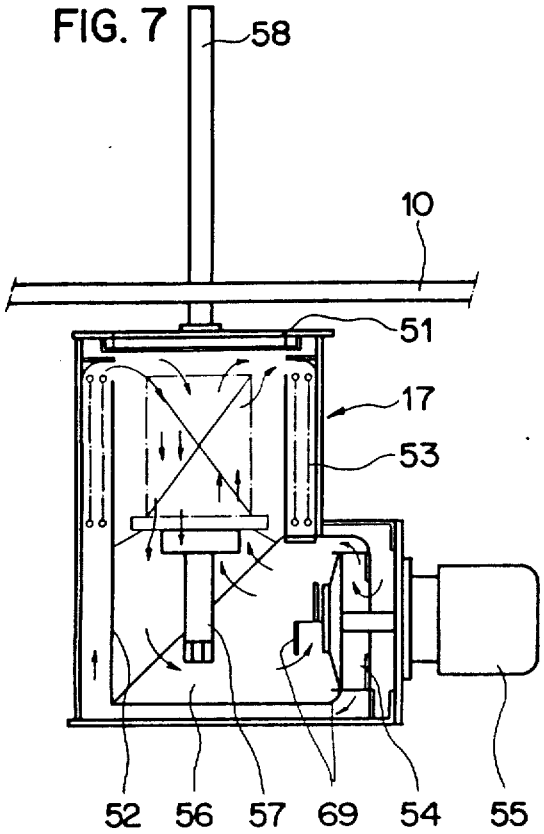
Figure 9:
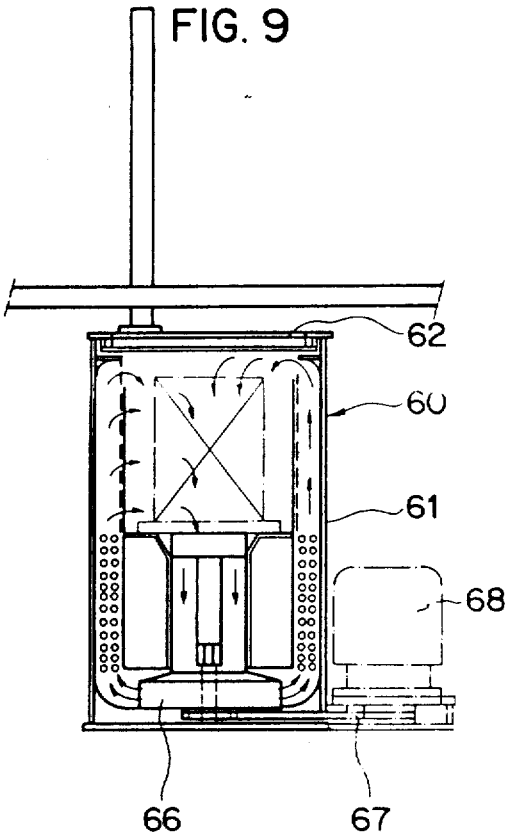
Figure 8:
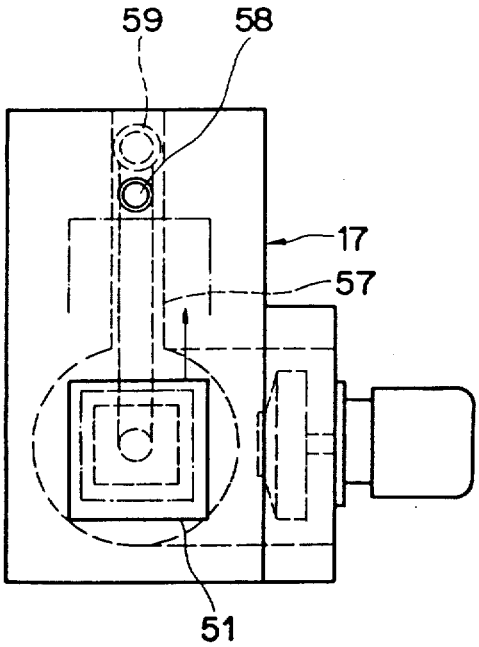
Figure 10:
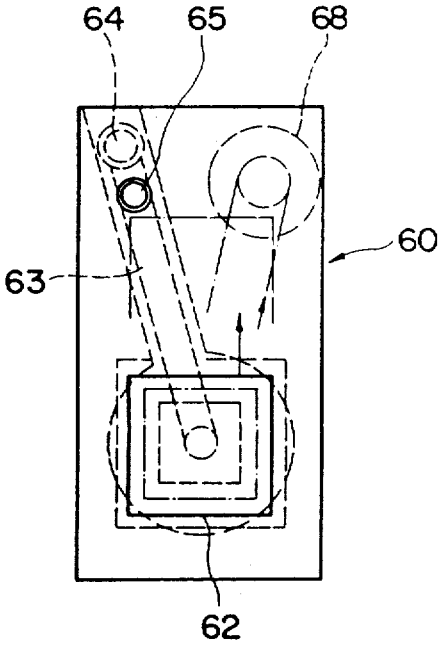

At 61 are seen the cooling elements situated within the vat. The latter is closed at the top by a square cover 62, and it comprises a lift 63 of the same design as the lift 57, but the bracket of which is oriented slightly obliquely. The guide column 64 is situated in a corner of the enclosure, and the jack 65 for maneuvering the lift is on the top face of the vat. The circulation of the gas is ensured by a vertical axis fan 66 situated in the bottom of the vat and driven via a belt 67 from a motor 68 which, as is seen in FIG. 10, is lodged in the rectangular bulk of the outside walls of the vat 60.

All the desired materials handling may be carried out easily by means of the car 6, the equipment 11, and the displacement means of the elements 7, 8 and 9. Thus, a charge, taken by the platform 25 of the materials handling car on one of the forks 23 integral with the turntable 20, may be moved on the conveyor track 5 so as to bring it beneath one of the furnaces 1, 2, 3 or 4. The furnace having been opened beforehand by tilting of its plug 37, the charge may be introduced, for example, into the bell 36 of the furnace 2 (FIG. 5) which, by a maneuver of lowering and rotation, brings the projections it has on its periphery into positions situated below the corners of the frame 24. Consequently, it suffices to lower the lift bracket 29 for the platform 25 to release the frame 24 of the charge and keep the latter secured to the bell 36. The car being moved again, the furnace can be reclosed and the required heat treatment engaged. It will be realized that all the transfer and movement operations are operations which take relatively very short times compared with the treatment times proper. Thus, after having put a charge in place in a furnace such as 2, the car may easily come to fetch another charge in the entry station in order to bring it, for example, into the washing station or into another one of the furnaces. Likewise, during the same lapse of time, one or more of the treatment elements 7, 8 and 9 may be displaced in order, for example, to permit the car 6 to transfer a charge to the handling equipment 11. In this case, the car having been brought into a position situated under this handling equipment, the charge will be lifted (FIG. 1) up to a position situated above the conveyor track 10. In this position, the fork of the handling equipment 11 may be inserted under the charge and thus take on the latter, which releases the car 6. From then on, the charge may be conveyed either into an unloading station (not depicted), situated at the end of the track 10, or transferred to one of the elements 17 or 60. Then it can be taken back by the equipment 11 and re-transferred to the car 6, which will bring it back to the entry station 20. This materials handling takes relatively little time compared to the immobilization time of the various treatment elements. Finally, there should be mentioned more especially the transfer operation which may be effected when a charge is conveyed directly from a furnace, or from another element of the upper line, into an element situated in the lower line. In this case, returning to FIG. 5, the furnace having been opened by lowering of the plate 38 at the moment when the heating treatment is terminated, the movable treatment element on the lower track, e.g., the element 8 is brought immediately under the furnace 2 , and it is by means of the lift 42 and the platform 43 that one operates from the moment of the transfer. The bell 36 is then lowered. The lift is raised until it supports the charge on the platform 43, after which the bell 36 releases the charge by a rotary movement. During the course of this movement, the lower edge of the bell presses on the edge of the opening of the top wall of the enclosure 40, which ensures the closing of a tight enclosure comprising the inside space of the furnace and that of the vat. The charge can consequently be lowered into the bath. When the conditions permit separating the two elements 2 and 8, one begins by replacing the drawer 48 which then permits reclosing the door 37, 38 of the furnace. The bell will then be remounted, if the case arises in several stages, so that as soon as the element 8 is released, it can be moved laterally.

Thus, the installation described permits all the position variants of materials handling, of transfer and of conveyance of charges, and this with a space requirement reduced to the minimum and the possibility of extending the installation by adding additional elements, either in fixed locations beside the vat 17 or on the conveyor track 5, or likewise in the upper line of furnaces.

This conception permits creating specific treatment elements which have been unknown until now, but the use of which is advantageous in connection with the installations described. Examples of such elements will be given below.

As a variant of the installation described, which comprises an unloading and discharge station at its left-hand end in FIG. 1, there might be provided at this left-hand end a station for transfer onto a track parallel to the two lines of the installation, extending laterally at mid-height, for example, so that the charges could be brought back from the left-hand end of the line toward the entry turntable 20 on a lateral pathway parallel to the track 5. This pathway would be situated, for example, at the level of the rotating platform 20 of the entry turntable. However, it follows from the above indications that the charges can always be brought back to the turntable 20 by means of the car 6, whatever the station in which they have undergone the last treatment. The turntable 20 can therefore operate in any case as a loading and unloading station.

In a typical execution, the following elements may be provided, for example:

(a) static or movable furnaces:
four furnaces having the following characteristics:
max. 600° C. under gas
max. 1100° C. under gas
max. 1230° C. under gas
max. 1100° C. under gas with cooler
(b) movable treatment elements:
water vat
oil vat, max. 100° C.
oil vat, max. 200° C.
salt vat, max. 600° C.
(c) fixed vats:
gas vat with cooler
gas vat with cooler under high pressure.
(d) auxiliary elements:
in the upper line, there may further be provided:
a pot-furnace for intermediate cooling with gaseous protection
a washing machine, max. 90° C.
in the lower line:
materials handling pot with gaseous protection
materials handling pot with gaseous protection and cooler.

All the operations of movement of the cars or the vats, as well as their opening and their closing, the engagement and the disengaging of the fans, the heating, the fluid circulations, may be controlled from a central station. Thus the charges of parts can pass from one element to another while being perfectly protected from oxidation. An installation of this kind permits, in certain cases, producing parts in an internal and external condition impossible to achieve until now. The controls of movable parts may be effected by jack. Thus it is possible to establish a control by program, checked and verified, in such a way as to run automatically, while ensuring all the required safety conditions.

We claim:

1. A metal charge treatment installation comprising a first set of treatment elements comprising at least one open-bottom furnace and a second set of treatment elements comprising at least one hardening vat and at least one car, wherein all of the elements of said second set are moveable along a common horizontal lower track, all of the elements of said first set are disposed in an upper position above said lower track, each of the elements of said first set comprises inner receiving means movable into an operative position for supporting a charge within a respective element of said first set and means associated with said respective element and independent from the second elements on the lower track for closing a bottom aperture of said respective element after a charge has been inserted therein, and each of the elements of said second set is provided with a lifting means comprising a platform able to support a charge and to insert it into an element of said first set placed above it.

2. An installation according to claim 1, wherein said track comprises a first end at which an entry and discharge station is provided and a second end remote from said station, said elements of said first set are disposed between said station and said second end and a transfer machine capable of receiving a charge from the lift of an element of said second set is placed at the level of said upper position between said first set of elements and said second end of said track.

3. An installation according to claim 2, wherein said transfer machine is movable on a horizontal upper track tending parallel to said lower track.

4. An installation according to claim 2, further comprising a third set of elements composed of at least one additional treatment element arranged so as to co-operate with the transfer machine for the unloading of a charge, said third set of elements being aligned from said second set.

5. An installation according to claim 1, wherein at least one of said elements of said first set is a bell furnace and said inner receiving means comprise support means integral with a bell of said bell furnace and an arrangement permitting said bell to rotate around a vertical axis.

6. An installation according to claim 2, wherein said transfer machine comprises a lift mounted on a car and capable of seizing a charge on the lift of an element of said second set, respective lifts of the transfer machine and the elements of the second set having complementary support means.

7. An installation according to claim 2, wherein the entry station comprises a turntable arranged for receiving and presenting charges in one or more directions and transferring the charges from the turntable to the car of the second set of elements at said first end of the track or from said car to the turntable.

8. An installation according to claim 1, wherein the lifts of the elements of the second set comprise a fixed guide column, a bracket guided by the guide column, and a vertical hydraulic jack comprising a piston integral with the bracket and a fixed cylinder.

9. An installation according to claim 1, wherein the first set of elements comprises a plurality of furnaces placed side by side along a straight line, closed at their bases by respective covers which pivot about axes parallel to said straight line and situated on first sides of the furnaces, and wherein at least some of the elements of the second set comprise lifts actuated by vertical jacks, the cylinders of which extend facing second sides of the furnaces opposite said first sides, respectively.

* * * * *

UNITED STATES PATENT AND TRADEMARK OFFICE

CERTIFICATE OF CORRECTION

PATENT NO. : 4,861,000

DATED : August 29, 1989

INVENTOR(S) : Pierre BEURET et al

It is certified that error appears in the above-identified patent and that said Letters Patent is hereby corrected as shown below:

IN THE ABSTRACT:

Line 3, change "moveable" to --movable--.

Line 5, change "," to --.--.

IN THE DRAWINGS:

The attached 6 drawing sheets depicting Figs. 1-10 should be substituted for the corresponding drawing sheets depicting Figs. 1-11 in the patent.

IN THE SPECIFICATION:

Col. 1, line 19, change "167,109" to --167,102--;

line 65, after "parts" insert --,--.

Col. 2, line 67, change "f" to --of--.

Col. 3, line 35, after "with" insert --,--.

Col. 4, line 17, change "2145/87" to --07/200,727--.

Col. 5, line 47, change "vertical axis" to --vertical-axis--;

IN THE CLAIMS:

Claim 1, col. 7, line 55, change "moveable" to --movable--.

UNITED STATES PATENT AND TRADEMARK OFFICE

CERTIFICATE OF CORRECTION

PATENT NO. : 4,861,000

DATED : August 29, 1989

INVENTOR(S) : Pierre Beuret, et al

It is certified that error appears in the above-identified patent and that said Letters Patent is hereby corrected as shown below:

Claim 3, col. 8, line 20, change "tending" to --extending--.

Signed and Sealed this

Twenty-ninth Day of January, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,861,000

DATED : Aug. 29, 1989

INVENTOR(S) : Pierre Beuret, et al.

It is certified that error appears in the above-identified patent and that said Letters Patent is hereby corrected as shown below:

The title page, showing the illustrative figure, should be deleted and substitute therefor the attached title page.

Signed and Sealed this

Sixteenth Day of March, 1993

*Attest:*

STEPHEN G. KUNIN

*Attesting Officer*

*Acting Commissioner of Patents and Trademarks*

United States Patent [19]

Beuret et al.

[11] Patent Number: 4,861,000

[45] Date of Patent: Aug. 29, 1989

[54] INSTALLATION HAVING SEVERAL ELEMENTS FOR HEAT TREATMENTS

[75] Inventors: Pierre Beuret, Route de Bure 21, 2900; Pascal Beuret, both of Porrentruy, Switzerland

[73] Assignee: Pierre Beuret, Switzerland

[21] Appl. No.: 200,417

[22] Filed: May 31, 1988

[30] Foreign Application Priority Data

Jun. 3, 1987 [CH] Switzerland ..... 2099/87

[51] Int. Cl.[4] ..... C21D 9/00

[52] U.S. Cl. ..... 266/143; 266/253; 266/263

[58] Field of Search ..... 286/142, 143, 263, 253, 286/259

[56] References Cited

U.S. PATENT DOCUMENTS

| | | | |
|---|---|---|---|
| 1,481,338 | 4/1922 | Baldwin | 266/249 |
| 1,838,015 | 12/1931 | Von Forster et al. | 266/253 |
| 1,876,960 | 9/1932 | Kenworthy | 266/253 |
| 3,381,947 | 5/1968 | Beggs | 266/259 |
| 4,415,145 | 11/1983 | Herdieckerhoff | 266/253 |

FOREIGN PATENT DOCUMENTS

| | | |
|---|---|---|
| 0167102 | 11/1950 | Austria . |
| 0023546 | 2/1981 | European Pat. Off. . |
| 1942801 | 5/1970 | Fed. Rep. of Germany . |
| 3525635 | 1/1987 | Fed. Rep. of Germany . |
| 1521505 | 3/1968 | France . |
| 0095877 | 11/1971 | France . |
| 0899793 | 6/1962 | United Kingdom . |

*Primary Examiner*—S. Kastler
*Attorney, Agent, or Firm*—Oliff & Berridge

[57] ABSTRACT

An upper line comprises three furnaces 1, 2, 3 and a washing machine 4, in straight side-by-side arrangement. A lower line comprises moveable treatment elements 7, 8, 9 movable on conveyor track 5, and fixed vat 17, Car 6 permits feeding all the elements of the upper line, as well as materials handling equipment 11, from entry station 20. Elements 7, 8, 9 and 17 can be fed either directly from the furnaces 1, 2, 3 via the materials handling equipment 11.

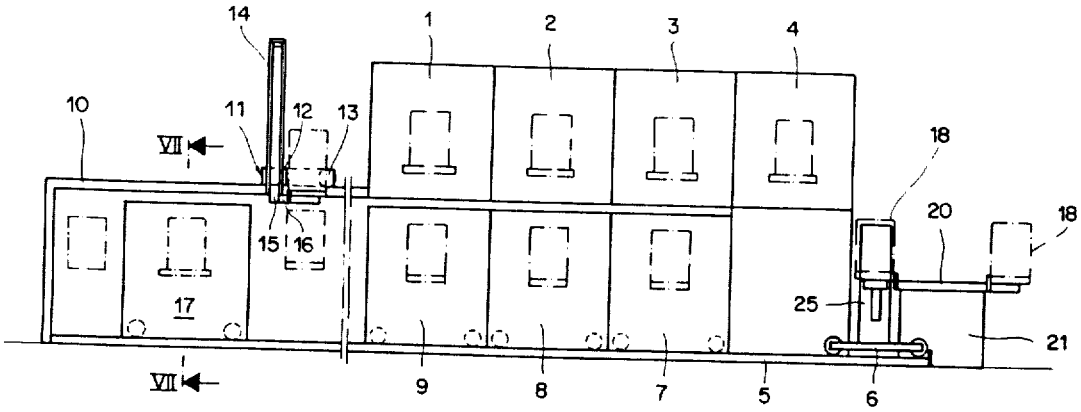

9 Claims, 6 Drawing Sheets